US011021866B2

(12) United States Patent
Mori et al.

(10) Patent No.: US 11,021,866 B2
(45) Date of Patent: Jun. 1, 2021

(54) BUILDING AND CONSTRUCTION METHOD FOR SAME

(71) Applicant: IIDA SANGYO CO., LTD., Tokyo (JP)

(72) Inventors: Kazuhiko Mori, Tokyo (JP); Moriyasu Nagayoshi, Tokyo (JP)

(73) Assignee: IIDA SANGYO CO., LTD., Tokyo (JP)

( * ) Notice: Subject to any disclaimer, the term of this patent is extended or adjusted under 35 U.S.C. 154(b) by 0 days.

(21) Appl. No.: 16/621,110

(22) PCT Filed: May 30, 2018

(86) PCT No.: PCT/JP2018/020717
§ 371 (c)(1),
(2) Date: Dec. 10, 2019

(87) PCT Pub. No.: WO2019/229870
PCT Pub. Date: Dec. 5, 2019

(65) Prior Publication Data

US 2020/0123763 A1 Apr. 23, 2020

(51) Int. Cl.
*E04B 1/26* (2006.01)
*E04B 1/58* (2006.01)

(52) U.S. Cl.
CPC ..... *E04B 1/26* (2013.01); *E04B 1/2604* (2013.01); *E04B 1/58* (2013.01);
(Continued)

(58) Field of Classification Search
CPC . E04B 1/26; E04B 1/2604; E04B 1/58; E04B 2001/262; E04B 2001/2672; E04B 2001/5887; E04B 2001/2644
See application file for complete search history.

(56) References Cited

U.S. PATENT DOCUMENTS 3,866,371 A * 2/1975 Falconer ..... E04B 1/2604 52/281
4,285,176 A * 8/1981 Runkle ..... E04B 1/26 52/234

(Continued)

FOREIGN PATENT DOCUMENTS

CA 3013892 A1 * 6/2018 ..... E04B 1/5831
GB 2 104 612 A 3/1983

(Continued)

OTHER PUBLICATIONS

Aug. 7, 2018 Search Report issued in International Patent Application No. PCT/JP2018/020717.

*Primary Examiner* — Jessie T Fonseca
(74) *Attorney, Agent, or Firm* — Oliff PLC

(57) ABSTRACT

A building and construction method include improved workability not causing variation in quality of buildings, by easily joining materials without special processing by forming mortises. A wooden building constructed by fitting horizontal and vertical members includes lower frames, first upper frames, second upper frames, and side joists as horizontal members; and pillars as vertical members, wherein the lower, first upper and second upper frames, and side joists include mortises at part of the lower, first upper and second upper frames, and side joists in longitudinal direction, the first upper frames include an entire length recessed groove in longitudinal direction, the second upper frames include an entire length protrusion in longitudinal direction, the mortises at the lower frames and the first upper frames are through holes, and the pillars include protrusions at both ends, fitting into the mortises at the lower, first upper and second upper frames, and side joists.

12 Claims, 8 Drawing Sheets

(52) U.S. Cl.
CPC . *E04B 2001/262* (2013.01); *E04B 2001/2644* (2013.01); *E04B 2001/2672* (2013.01); *E04B 2001/5887* (2013.01)

(56) References Cited

U.S. PATENT DOCUMENTS

| | | | | | |
|---|---|---|---|---|---|
| 4,479,342 | A * | 10/1984 | Eberle | E04B 1/26 33/613 |
| 5,832,689 | A * | 11/1998 | Curll | A47B 47/0041 52/656.9 |
| 9,322,158 | B1 * | 4/2016 | Langmeier | E04C 3/42 |
| 2005/0055966 | A1 * | 3/2005 | Conroy | E04C 3/12 52/120 |
| 2005/0066615 | A1 * | 3/2005 | Wilhour | E04B 1/26 52/653.1 |

FOREIGN PATENT DOCUMENTS

| | | | | |
|---|---|---|---|---|
| JP | S35-10241 | Y1 | 5/1960 | |
| JP | H08-105129 | A | 4/1996 | |
| JP | 2002-364069 | A | 12/2002 | |
| JP | 2003-155781 | A | 5/2003 | |
| JP | 2006-322275 | | 11/2006 | |
| JP | 2009-091848 | A | 4/2009 | |
| JP | 3177809 | U | 8/2012 | |
| JP | 2012-184565 | A | 9/2012 | |
| JP | 2012-219496 | A | 11/2012 | |
| WO | WO-2012004633 | A1 * | 1/2012 | E04B 2/46 |
| WO | WO-2012125595 | A1 * | 9/2012 | E04C 3/11 |
| WO | 2019/016979 | A1 | 1/2019 | |
| WO | WO-2020041457 | A1 * | 2/2020 | E04B 1/78 |

* cited by examiner

BUILDING AND CONSTRUCTION METHOD FOR SAME

BACKGROUND OF THE INVENTION

Field of the Invention

Present invention relates to a wooden building comprising horizontal members and vertical members to be fitted to the horizontal members, and construction method for same.

Description of Related Art

A wooden wall frame construction method (Hereinafter, referred to as "two by four construction method" or "2×4 construction method") is often used for recent buildings.

For example, in Patent Literature 1, it is proposed to use two by four material of (37 mm to 39 mm)×(88 mm to 90 mm) with a length of integral multiple of 1 inch, instead of framework material, as a stud to be built between the pillars, in order to decrease materials and man-hours in conventional (framework) construction method.

In addition, in Patent Literature 2, a wall structure of two by four constructed by connecting panels extended with outer wall plate (3) at external surface (1A) and having a header support (1) at end surface for connecting adjacent panels accurately in identical plane and for improving connection strength, wherein studs (4) are fixed at connected surfaces of panels at both sides, is proposed.

Patent Literature 1: JP 2012-219496 A

Patent Literature 2: JP H8-105129 A

SUMMARY OF THE INVENTION

However, in a conventional method, at a position where a joint will be required, a special processing was necessary. In addition, as special processing is necessary, a variation in a quality of buildings occurs by skills of workers.

Here, the purpose of the present invention is to provide a building and a construction method with improved workability, and also, which does not cause a variation in a quality of buildings, by enabling materials to be joined easily without special processing by forming mortises.

A building relating to one embodiment of the present invention is a wooden building constructed by fitting horizontal members and vertical members, comprising: lower frames, first upper frames, second upper frames, and side joists as the horizontal members; and pillars as the vertical members, wherein the lower frames, the first upper frames, the second upper frames, and the side joists are provided with mortises at least at a part of the lower frames, the first upper frames, the second upper frames, and the side joists in longitudinal direction, the first upper frames are provided with a recessed groove over entire length in longitudinal direction, the second upper frames are provided with a protrusion over entire length in longitudinal direction, the mortises provided at the lower frames and the first upper frames are through holes, and the pillars are provided with protrusions at both ends, which can be fitted into the mortises provided at the lower frames, the first upper frames, the second upper frames, and the side joists.

In this way, it is possible to provide a building with improved workability, and also, which does not cause a variation in a quality of buildings, by enabling materials to be joined easily without special processing by forming mortises.

At this time, in one embodiment of the present invention, it is further comprising third upper frames as the horizontal members, and the third upper frames may be provided to be fitted to the second upper frames such that a difference at one side of the protrusion provided at the second upper frames will be absorbed.

In this way, the third upper frames can be put on the second upper frames stably, so it is possible to raise a height of a ceiling.

At this time, in one embodiment of the present invention, the mortises provided at the lower frames are formed by two or more intermediate sawn plates aligned at intervals in a line of horizontal direction, and by two sawn plates interposing the intermediate sawn plates at both sides and having longer entire length than the two or more intermediate sawn plates, the intermediate sawn plates and two sawn plates at both sides are having same plate width, and the mortises provided at the first upper frames and the second upper frames are formed by two or more intermediate sawn plates aligned at intervals in a line of horizontal direction, and by two sawn plates interposing the intermediate sawn plates at both sides and having longer entire length than the two or more intermediate sawn plates, the intermediate sawn plates and two sawn plates at both sides are having same plate width or different plate width, and the recessed groove provided at the first upper frames is formed by interposing the intermediate sawn plates at both sides by two sawn plates having wider plate width than the intermediate sawn plates, and the protrusion provided at the second upper frames is formed by providing a sawn plate with same plate width as the two sawn plates at both sides of the second upper frames on the intermediate sawn plates of the second upper frames, the mortises provided at the side joists are formed by two sawn plates with same plate width and two or more sawn plates with different plate width provided at intervals on one of the two sawn plates which fits into the recessed groove of the first upper frames, and the protrusions provided at the pillars are formed by interposing one intermediate sawn plate at both sides by two sawn plates having shorter entire length than the intermediated sawn plate, the intermediate sawn plate and two sawn plates at both sides are having same plate width.

In this way, the mortises of the lower frames, the first upper frames, the second upper frames, the side joists, or the recessed groove of the first upper frames, and the protrusions of the pillars are formed clearly, and it is possible to provide a building with improved workability, and also, which does not cause a variation in a quality of buildings, by enabling materials to be joined easily without special processing by forming mortises.

The building further comprises fixing metal fittings for joining the pillars to the lower frames, the fixing metal fittings are respectively provided with a joint base in groove shape mainly composing the joint metal, and a cover spacer in groove shape capable of supporting axial load of a pillar of the pillars by covering an open surface of the joint base, the joint base comprises: a plane section in rectangular shape in which bolt holes are drilled and a shape of which coincides with an end surface of the pillar; a pair of groove walls composed of side edges of the plane section respectively bent vertically in L shape; and a joining plate standing at a height surpassing the groove walls from the plane section and supported by welded part contacting at least the pair of the groove walls or a groove bottom, the cover spacer comprises: a plane section in rectangular shape for supporting the pillar by abutting to the end surface of the pillar; a pair of groove walls composed of side edges of the plane section respectively bent vertically in L shape; and a slit drilled such that the joining plate will be fitted into the slit when covering the joint base, wherein in a state assembled as the joint metal, fastening bolts penetrated through or embedded in a horizontal member of the horizontal members are penetrated through the bolt holes, and the plane section of the joint base is fastened to the horizontal member by a nut, further, the joining plate is penetrated through the slit, and also, tips of the fastening bolts and the nuts screwed to the fastening bolts are housed in a box-shaped space surrounded by the joint base and the cover spacer, the end surface of the pillar abuts the plane section of the cover spacer, and also, the pillar and the joining plate fitted into a groove hole drilled at the pillar are drift-pin joined by a plurality of drift pins.

In this way, it is possible to provide a building with improved workability, and also, which does not cause a variation in a quality of buildings, by enabling materials to be joined easily without special processing, as the pillars can be fitted easily to the lower frames and structural strength will be improved.

In addition, in one embodiment of the present invention, a depth of the mortises of the lower frames, the first upper frames, the second upper frames, and the side joists may be larger than a height of the protrusions of the pillars.

In this way, it is possible to provide a building not causing a variation in a quality of buildings further, as the pillars will be able to be fitted to the lower frames, the first and second upper frames, and the side joists, even if the protrusions of the pillars are expanded by humidity and become higher than a depth of the mortises of the lower frames, the first and second upper frames, and the side joists, and a depth of the recessed groove of the first upper frames.

In addition, in one embodiment of the present invention, a protrusion or a recess may be provided at both ends in longitudinal direction of each of the lower frames, the first upper frames and the second upper frames.

In this way, coupling of the lower frames themselves and the upper frames themselves will be easy.

In addition, in one embodiment of the present invention, 204 material, 205 material, 206 material, 208 material, 210 material, and 212 material may be used as the horizontal members and vertical members.

In this way, it is possible to correspond to various materials.

In addition, in one embodiment of the present invention, the lower frames, the first upper frames, the second upper frames, the side joists, and the pillars may be formed in equivalent shape from solid wood, laminated wood, or laminated veneer lumber.

In this way, it is possible to correspond to solid wood, laminated wood, or laminated veneer lumber.

In addition, in other embodiment of the present invention, it is a construction method for fitting and assembling at least horizontal members and vertical members at the construction site, comprising: a horizontal member forming step for forming the horizontal members; a vertical member forming step for forming the vertical members; and an assembling step for fitting and assembling the horizontal members and the vertical members, wherein lower frames, first upper frames, second upper frames and side joists are provided as the horizontal members, pillars are provided as the vertical members, the lower frames, the first upper frames, the second upper frames, and the side joists are provided with mortises at least at a part of the first upper frames, the second upper frames, and the side joists in longitudinal direction, the first upper frames are provided with a recessed groove over entire length in longitudinal direction, the second upper frames are provided with a protrusion over entire length in longitudinal direction, the mortises provided at the lower frames and the first upper frames are through holes, and the pillars are provided with protrusions at both ends, which can be fitted into the mortises provided at the lower frames, the first upper frames, the second upper frames, and the side joists.

In this way, it is possible to provide a construction method with improved workability, and also, which does not cause a variation in a quality of buildings, by enabling materials to be joined easily without special processing by forming mortises.

At this time, in one embodiment of the present application, third upper frames are further provided as the horizontal members, and the third upper frames may be provided to be fitted to the second upper frames such that a difference at one side of the protrusion provided at the second upper frames will be absorbed.

In this way, the third upper frames can be put on the second upper frames stably, so it is possible to raise a height of a ceiling.

In addition, in other embodiment of the present invention, the mortises provided at the lower frames are formed by two or more intermediate sawn plates aligned at intervals in a line of horizontal direction, and by two sawn plates interposing the intermediate sawn plates at both sides and having longer entire length than the two or more intermediate sawn plates, the intermediate sawn plates and the two sawn plates at both sides are having same plate width, and the mortises provided at the first upper frames and the second upper frames are formed by two or more intermediate sawn plates aligned at intervals in a line of horizontal direction, and by two sawn plates interposing the intermediate sawn plates at both sides and having longer entire length than the two or more intermediate sawn plates, the intermediate sawn plates and the two sawn plates at both sides are having same plate width or different plate width, and the recessed groove provided at the first upper frames is formed by interposing the intermediate sawn plates at both sides by the two sawn plates having wider plate width than the intermediate sawn plates, and the protrusion provided at the second upper frames is formed by providing a sawn plate with same plate width as the two sawn plates at both sides of the second upper frames on the intermediate sawn plates of the second upper frames, the mortises provided at the side joists are formed by two sawn plates with same plate width and two or more sawn plates with different plate width provided at intervals on one of the two sawn plates which fits into the recessed groove of the first upper frames, and protrusions provided at the pillars are formed by interposing one intermediate sawn plate at both sides by two sawn plates having shorter entire length than the intermediated sawn plate, the intermediate sawn plate and the two sawn plates at both sides are having same plate width.

In this way, the mortises of the lower frames, the first upper frames, the second upper frames, the side joists, or the recessed groove of the first upper frames, and the protrusions of the pillars are formed clearly, and it is possible to provide a construction method with improved workability, and also, which does not cause a variation in a quality of buildings, by enabling materials to be joined easily without special processing by forming mortises.

In addition, in other embodiment of the present invention, the horizontal member forming step and/or the vertical member forming step may be performed at the construction site.

In this way, it is possible to provide a construction method with more improved workability, and also, which does not cause a variation in a quality of buildings.

As explained in the above, according to the present invention, it is possible to provide a building and a construction method with improved workability, and also, which does not cause a variation in a quality of buildings, by enabling materials to be joined easily without special processing by forming mortises.

BRIEF DESCRIPTION OF THE DRAWINGS

FIG. 5(A) is a schematic view of a first upper frame, and FIG. 5(B) is a schematic view of a second upper frame, and FIG. 5(C) is a schematic view of a third upper frame, and FIG. 5(D) is a schematic view illustrating a joining of the first upper frames themselves and the pillar.

FIG. 6(A) is a schematic view of a side joist, and FIG. 6(B) is a schematic view of a joist single, and FIG. 6(C) is a schematic view of a joist triple.

DETAILED DESCRIPTION OF THE INVENTION

A wooden framework construction method (hereinafter, referred to as "conventional construction method") is a traditional construction method in Japan, and it is a construction method for assembling by providing joints to precut pillars and beam materials, and by reinforcing with metal fittings. A wooden framework panel construction method (hereinafter, referred to as "I.D.S construction method") based on this construction method also belongs to a category of the conventional construction method basically. On the other hand, 2×4 construction method is a traditional construction method in North America, and it is having an advantage that advanced processing technique is not necessary, as standardized panels are assembled by metal fittings or nailing. In addition, a wooden framework is assembled by structural materials.

As lumbers for 2×4 construction method, it is defined in JAS (Japanese Agricultural Standard), but woods with prescribed size specified by names below are used. In other words, 1×4 (19×89 mm for dried wood), 1×6, 2×2, 2×3, 2×4 (204 material), 2×5 (205 material), 2×6 (206 material), 2×8, 2×10 (210 material), 2×12, 4×4 (404 material), and 4×6 (406 material) with different sectional shapes are used. In addition, the names are derived from inch size, but actual sizes are smaller than the named inch size.

Hereinafter, it is explained in detail about preferred embodiments of the present invention, in the following order. In addition, the embodiments of the present invention explained in below should not unjustly limit the content of the present invention described in claims, and not all of the features explained in the embodiments of the present invention are necessary as means for solving the problem of the present invention. In addition, about a building and a construction method relating to one embodiment of the present invention, it is not limited to 2×4 building.

1. Building
2. Construction method
2-1. Horizontal member forming step
2-2. Vertical member forming step
2-3. Assembling step

[1. Building]

Figure 1:
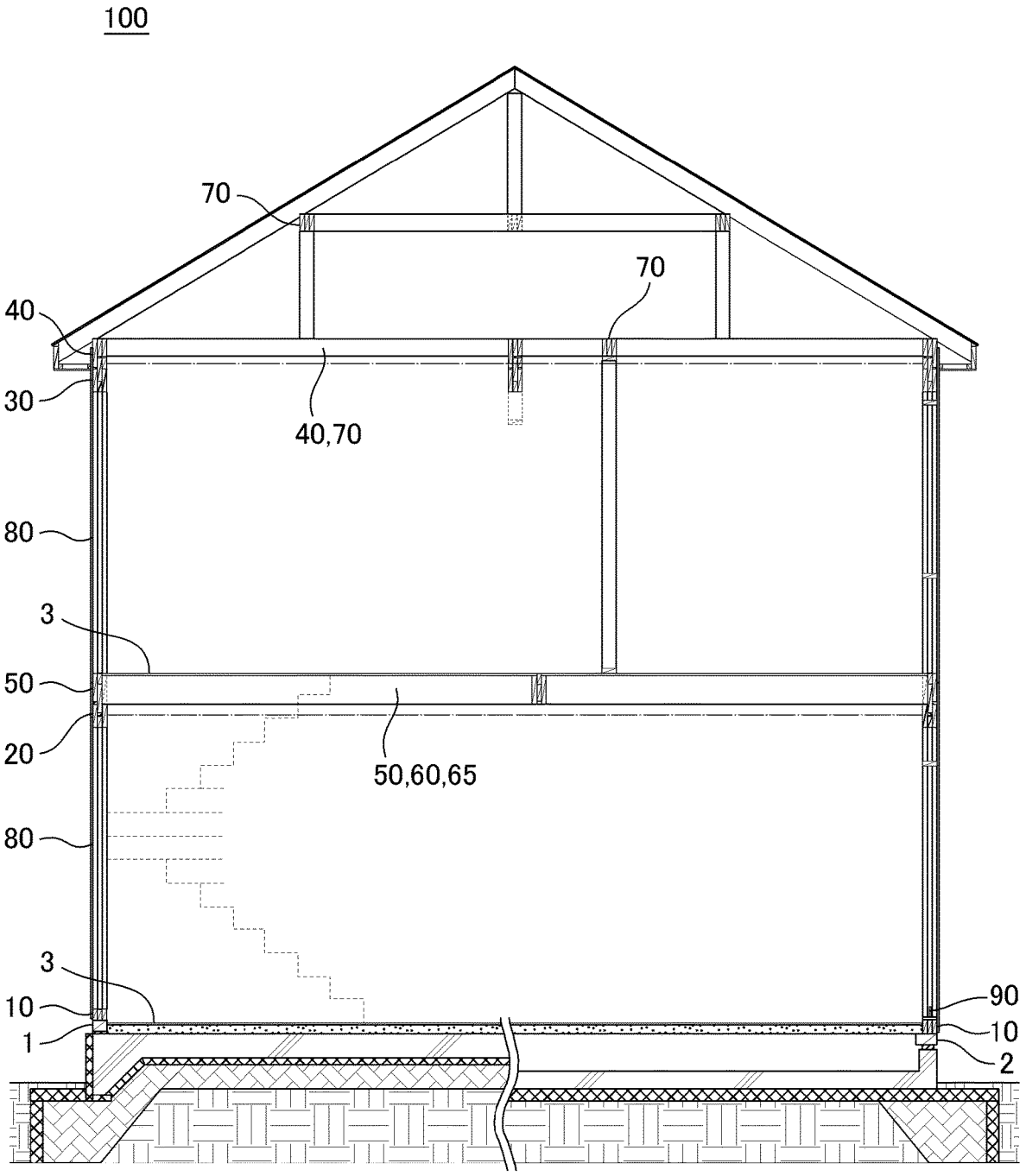
FIG. 1 is a schematic view illustrating a building relating to one embodiment of the present invention.

FIG. 1 is a schematic view illustrating a building 100 relating to one embodiment of the present invention. As illustrated in FIG. 1, the building 100 relating to one embodiment of the present invention is a wooden building constructed by fitting horizontal members arranged horizontally and vertical members arranged vertically, wherein lower frames 10, first upper frames 20, second upper frames 30, and side joists 50 are provided as the horizontal members, and pillars 80 are provided as the vertical members.

It will be described in detail later, but the lower frames 10, the first upper frames 20, the second upper frames 30, and the side joists 50 are provided with mortises 15, 25, 35, 55 at least at a part of the lower frames 10, the first upper frames 20, the second upper frames 30, and the side joists 50 in longitudinal direction, the first upper frames 20 are provided with a recessed groove 23 over entire length in longitudinal direction, the second upper frames 30 are provided with a protrusion 36 over entire length in longitudinal direction, the mortises 15, 25 provided at the lower frames 10 and the first upper frames 20 are through holes, and the pillars 80 are provided with protrusions 83 at both ends, which can be fitted into the mortises 15, 25, 35, 55 provided at the lower frames 10, the first upper frames 20, the second upper frames 30, and the side joists 50.

As illustrated in FIG. 1, a sill 1 is provided on a foundation, and the lower frames 10 are provided on the sill 1. In addition, after providing the lower frames 10, as illustrated in FIG. 1, floor materials such as floor plywood 3 may be laid. Publicly known materials are used for the floor materials.

Figure 2:
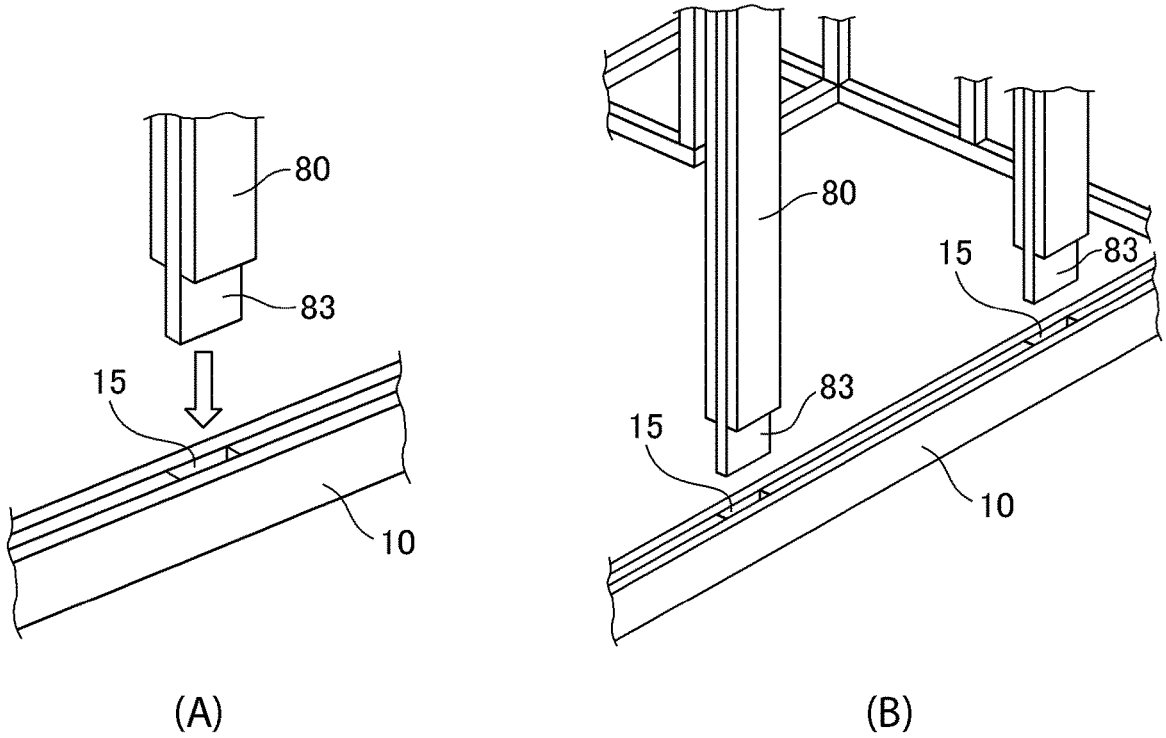
FIG. 2 is a schematic view illustrating an assembly of lower frames and pillars used for the building relating to one embodiment of the present invention.

As illustrated in FIG. 2, lower protrusions of the protrusions 83 provided at both ends of the pillars 80 are fitted to the mortises 15 provided at least at a part of the lower frames 10 in longitudinal direction, and the pillars 80 will be self-stood. In this way, the pillars 80 are able to self-stand stably by providing the mortises 15. As the pillars 80 are able to self-stand stably, mounting of the first upper frames 20 and the second upper frames 30 will be very easy.

Figure 3:
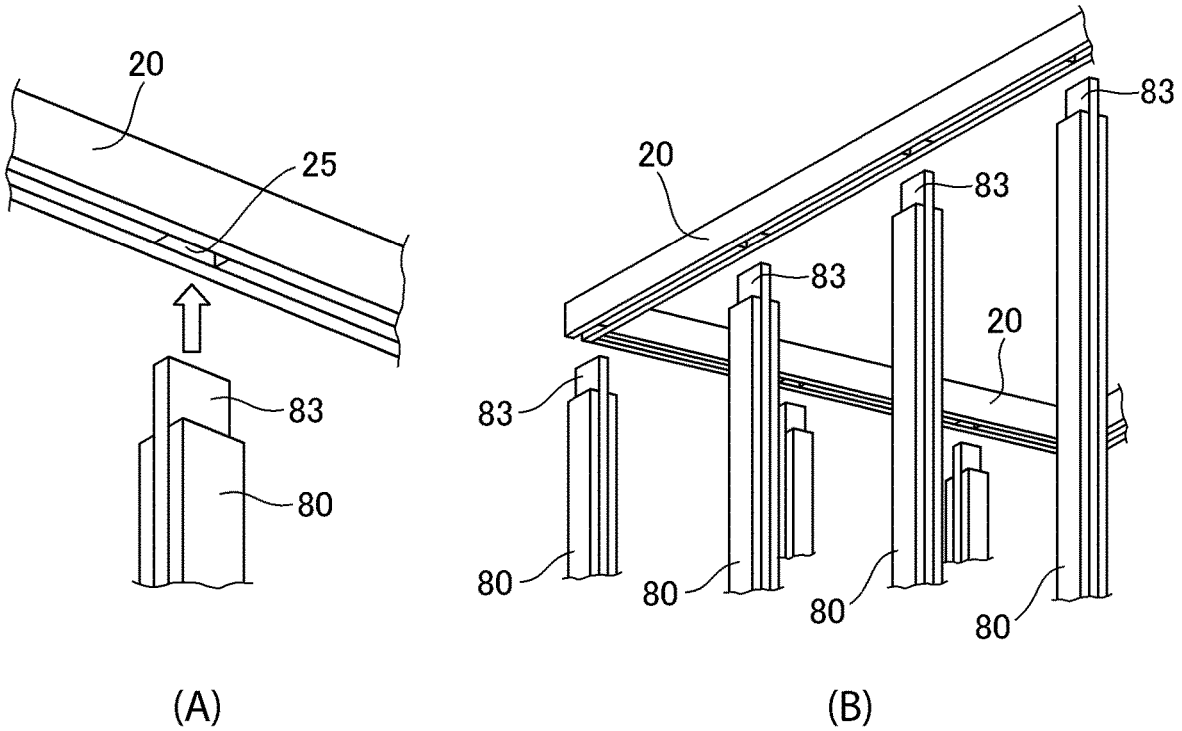
FIG. 3 is a schematic view illustrating an assembly of the pillars and first upper frames used for the building relating to one embodiment of the present invention.

In addition, as illustrated in FIG. 3, the mortises 25 provided at least at a part of the first upper frames 20 in longitudinal direction will be fitted to upper protrusions 83 of self-standing pillars 80. By providing the mortises 15, 25 as illustrated in FIGS. 2 and 3, positions of the pillars 80 will also be clear, so it is possible to construct the building 100 easily, and to improve workability.

In addition, when the building 100 is one-story building, the second upper frames 30 will be used instead of the first upper frames 20 in FIG. 3. The second upper frames 30 will be provided on the pillars 80 provided on the top floor.

As illustrated in FIGS. 1 to 3, the first upper frames 20 are provided with the recessed groove 23 over entire length in longitudinal direction, and the side joists 50 are fitted to the recessed groove 23, and cleats are provided at the side joists 50 to provide joists. The cleats regulate a distance between the joists, a plurality of which are standing with spacings, and maintains verticality, so they are having an effect as cleats. In addition, an effect to improve the structural strength can be obtained by the cleats.

Figure 6:
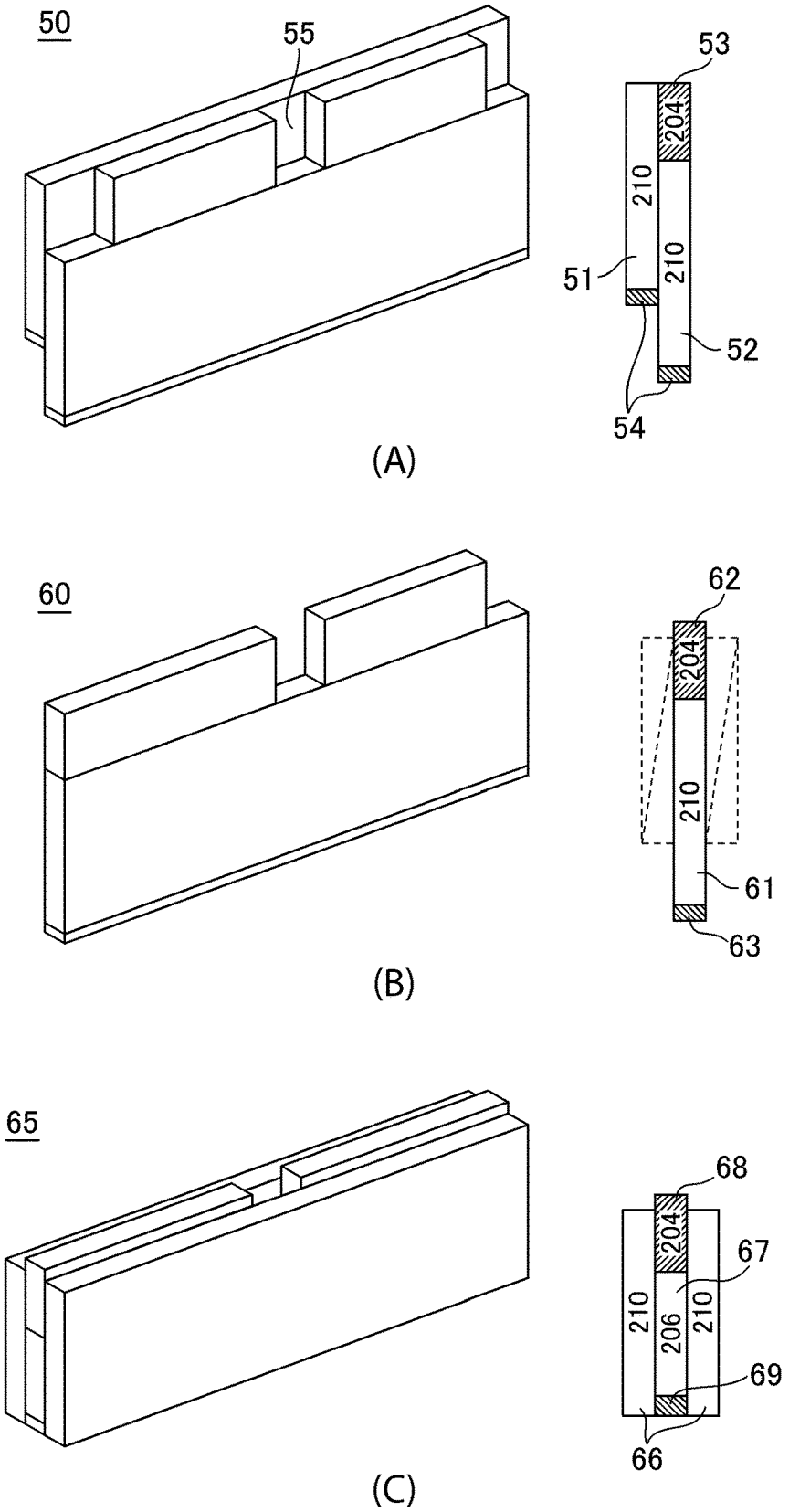
FIG. 6 is a schematic view illustrating joists used for the building relating to one embodiment of the present invention.

Floor materials such as floor plywood 3 may be laid on the joists. Publicly known materials are used for the floor materials. By the above, the first floor and the floor of the second floor are constructed. As the joists, joists as illustrated in FIG. 6 will be used. It will be described in detail later.

Next, the protrusions 83 provided at the pillars 80 are fitted to the mortises 55 provided at the side joists 50, and the pillars 80 of the second floor will be self-stood. When the building 100 is two-story building, the mortises 35 provided at least at a part of the second upper frames 30 in longitudinal direction will be fitted to upper protrusions 83 of self-standing pillars 80.

In addition, it further comprises third upper frames 40 as the horizontal members, and it is preferable that the third upper frames 40 are provided to be fitted to the second upper frames 30 such that a difference at one side of the protrusion 36 provided at the second upper frames 30 will be absorbed.

Further, it is preferable to further comprise roof beams 70 as the horizontal members. The roof beams 70 are provided with mortises 73 at least at a part of the roof beams 70 in longitudinal direction, and it is preferable that the mortises 73 are through holes. The protrusions 83 of the pillars 80 are fitted to the mortises 73.

As the above, when it is two-story building, it may be provided in order of the lower frames 10, the pillars 80, the first upper frames 20, and the side joists 50 on the first floor, and in order of the pillars 80 and the second upper frames 30 on the second floor. In addition, when it is three-story building, the first upper frames 20 will be used instead of the second upper frames 30 provided on the pillars 80 of the second floor. In other words, it may be provided in order of the lower frames 10, the pillars 80, the first upper frames 20, and the side joists 50 on the first floor, and in order of the pillars 80, the first upper frames 20, and the side joists 50 on the second floor, and in order of the pillars 80 and the second upper frames 30 on the third floor. As such, the first upper frames 20, the second upper frames 30, the side joists 50, and the pillars 80 may be selected and provided according to desired number of stories.

And, when the third upper frames 40 are provided, struts will be stood on the third upper frames 40 or the roof beams 70, and purlins and ridgepoles are built, and rafters and roof boards are applied.

Next, concretely explaining the horizontal members and the vertical members used in the building 100 relating to one embodiment of the present invention using FIGS. 4 to 8. The lower frames 10, the first upper frames 20, the second upper frames 30, and the side joists 50 are provided as the horizontal members used in the building 100 relating to one embodiment of the present invention. In addition, the pillars 80 and framework walls are provided as the vertical members used in the building 100 relating to one embodiment of the present invention. Hereinafter, explained in detail.

Figure 4:
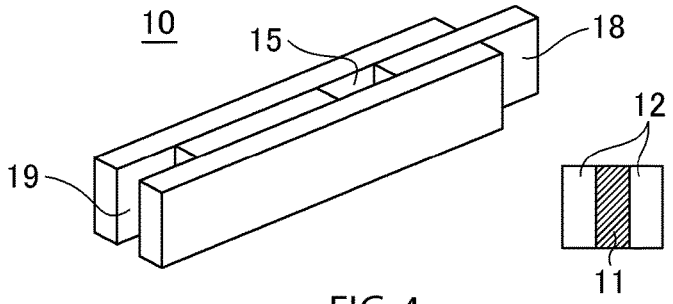
FIG. 4 is a schematic view illustrating a lower frame used for the building relating to one embodiment of the present invention.

FIG. 4 is a schematic view illustrating a lower frame 10 used for the building relating to one embodiment of the present invention. For example, the lower frame 10 may be formed by using three 204 materials or the like. The lower frame 10 is provided with a mortise 15 at least at a part of the lower frame 10 in longitudinal direction, and a plurality of mortises 15 may be provided according to a number of the pillars 80 used. The mortise 15 is a through hole. And, it is preferable that the mortise 15 provided at the lower frame 10 is formed by two or more intermediate sawn plates 11 aligned at intervals in a line of horizontal direction, and by two sawn plates 12 interposing the intermediate sawn plates 11 at both sides and having longer entire length than the two or more intermediate sawn plates 11, and that the intermediate sawn plates 11 and two sawn plates 12 at both sides are having same plate width.

Figure 5:
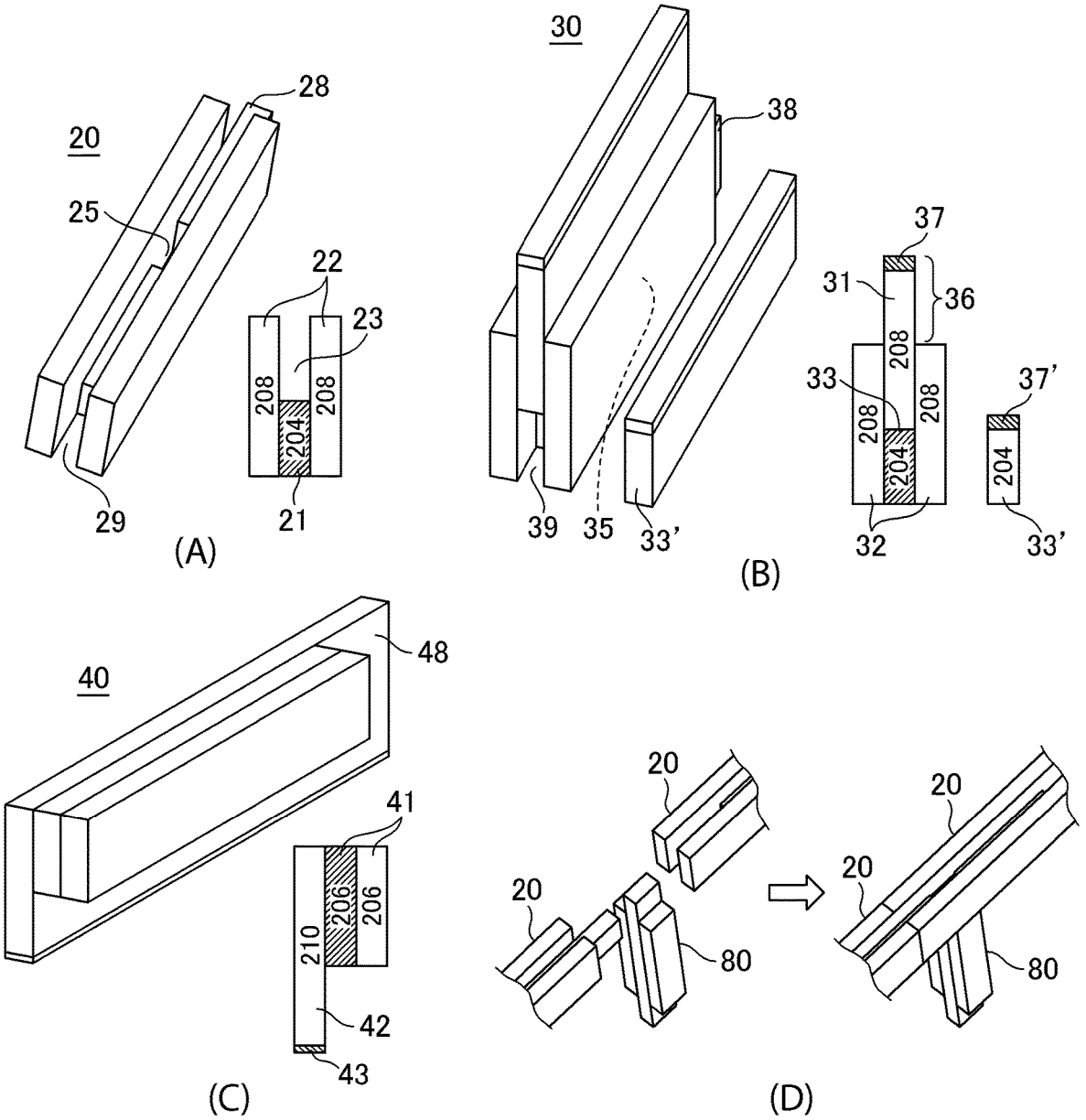
FIG. 5 is a schematic view illustrating upper frames used for the building relating to one embodiment of the present invention.

FIG. 5 is a schematic view illustrating upper frames used for the building 100 relating to one embodiment of the present invention. As illustrated in FIG. 5(A), for example, a first upper frame 20 may be formed by using two 208 materials and 204 material with different plate width. The first upper frame 20 is also provided with a mortise 25 at least at a part of the first upper frame 20 in longitudinal direction, and a plurality of mortises 25 may be provided according to a number of the pillars 80 used. In addition, the first upper frame 20 is provided with a recessed groove 23 over entire length in longitudinal direction. The mortise 25 is a through hole. It is preferable that the recessed groove 23 provided at the first upper frame 20 is formed by interposing an intermediate sawn plate 21 of 204 material at both sides by two sawn plates 22 of 208 material having wider plate width than the intermediate sawn plate 21. And, it is preferable that the mortise 25 provided at the first upper frame 20 is formed by two or more intermediate sawn plates 21 aligned at intervals in a line of horizontal direction, and by two sawn plates 22 interposing the intermediate sawn plates 21 at both sides and having longer entire length than the two or more intermediate sawn plates 21, the intermediate sawn plates 21 and two sawn plates 22 at both sides are having same plate width or different plate width.

In addition, on the pillars 80 of the top floor, a second upper frame 30 as illustrated in FIG. 5(B) may be used instead of the first upper frame 20 as illustrated in FIG. 5(A). As illustrated in FIG. 5(B), the second upper frame 30 is formed by using three 208 materials, and a protrusion 36 is formed by deviating an intermediate sawn plate 31 of 208 material in upper direction. In addition, according to FIG. 5(B), a sawn plate 33' of 204 material may be provided further on a right-side sawn plate of 208 material. In this way, a roof beam 70 illustrated in FIG. 7 can be put on the second upper frame 30 stably, so it is possible to raise a height of a ceiling.

For example, as illustrated in FIG. 5(B), it is preferable that a mortise 35 provided at the second upper frame 30 is formed by two or more intermediate sawn plates 33 of 204 material aligned at intervals in a line of horizontal direction, and by two sawn plates 32 interposing the intermediate sawn plates 33 at both sides and having longer entire length than the two or more intermediate sawn plates 33, the intermediate sawn plates 33 and two sawn plates 32 at both sides are having same plate width or different plate width. In addition, the mortise 35 of the second upper frame 30 can be formed as same as the mortise 25 of the first upper frame 20.

After providing the second upper frame 30, as illustrated in FIG. 5(B), at the top floor, it is preferable to provide a third upper frame 40, as illustrated in FIG. 5(C), on the second upper frame 30. It is preferable that the third upper frame 40 is provided to be fitted to the second upper frame 30 such that a difference at one side of the protrusion 36 provided at the second upper frame 30 will be absorbed. According to FIG. 5(B), the third upper frame 40 is provided to be fitted to a difference at left side of the protrusion 36 of the second upper frame 30. For example, the third upper frame 40 is formed by one sawn plate 42 of 210 material and two sawn plates 41 of 206 material having different entire length or same entire length with respect to the sawn plate 42. By providing the third upper frame 40, it is possible to absorb a difference at one side of the protrusion 36, so upper surface will be more planar shape, and a structure for supporting a roof, a strut, and a rafter will be more stabilized.

In addition, as illustrated in FIGS. 4, 5(A) and (B), it is further preferable to provide a protrusion 18, 28, 38 or a recess 19, 29, 39 at both ends in longitudinal direction of the lower frame 10, the first upper frame 20, and the second upper frame 30. The protrusion 18, 28, 38 or the recess 19, 29, 39 provided at both ends in longitudinal direction are formed by deviating the intermediate sawn plates 11, 21, 33 of 204 material in longitudinal direction. In this way, as illustrated in FIG. 5(D), the lower frames 10, the first upper frames 20, or the second upper frames 30 themselves can be joined easily. In addition, in FIG. 5(D), a joining of the first upper frames 20 themselves and a joining of the pillar 80 is illustrated as an example.

In addition, as illustrated in FIG. 5(C), it is further preferable to provide protrusions 48 at both ends in longitudinal direction of the third upper frame 40. The protrusions 48 provided at both ends in longitudinal direction may be formed by deviating one sawn plate 42 of 210 material and two sawn plates 41 of 206 material in longitudinal direction.

As mentioned above, the protrusions 83 of the pillars 80 are fitted to the mortises 25, 35 formed in the first upper frames 20 or the second upper frames 30 from below. And, the side joists 50 are provided on the first upper frames 20, concretely, the side joists 50 are fitted to the recessed groove 23 formed in the first upper frames 20. In addition, the third upper frames 40 are provided on the second upper frames 30, concretely, the third upper frames 40 are provided to be fitted to the second upper frames 30 such that a difference at one side of the protrusion 36 provided at the second upper frames 30 will be absorbed.

FIG. 6 is a schematic view illustrating joists used for the building 100 relating to one embodiment of the present invention. As illustrated in FIG. 6(A), for example, a side joist 50 may be formed by using two sawn plates 51, 52 of 210 material and sawn plates 53 of 204 material having different plate width with respect to the two sawn plates 51, 52. A mortise 55 is also provided at least at a part of the side joist 50 in longitudinal direction, and a plurality of mortises 55 may be provided according to a number of the pillars 80 used. In addition, it is preferable that the mortise 55 provided at the side joist 50 is formed by are formed by two sawn plates 51, 52 having same plate width, and by two or more sawn plates 53 aligned at intervals on the sawn plate 52 at a side fitted to the recessed groove 23 of the first upper frame 20, and having different plate width with respect to the two sawn plates 51, 52.

Further, as the joist, a joist single 60 illustrated in FIG. 6(B), or a joist triple 65 illustrated in FIG. 6(C) may be used. The joist single 60 may be formed, for example by providing sawn plates 62 of 204 material on a sawn plate 61 of 210 material. In addition, the joist triple 65 may be formed, for example by providing two sawn plates 66 of 210 material at both sides of one intermediate sawn plate 67 of 206 material, and by providing sawn plates 68 of 204 material on the intermediate sawn plate 67 of 206 material. And, floor materials such as floor plywood may be laid on the joists 60, 65.

In addition, it is preferable to provide a packing 37 on the intermediate sawn plate 31 of 208 material forming the protrusion 36 of the second upper frame 30 illustrated in FIG. 5(B). Also, it is preferable to provide a packing 43, 54, 63, 69 under the sawn plate 42 of 210 material illustrated in FIG. 5(C), under the sawn plates 51, 52, 61 of 210 material illustrated in FIGS. 6(A) and (B), and under the intermediate sawn plate 67 of 206 material illustrated in FIG. 6(C). By providing the packing as the above, there will be no level difference between the first upper frames 20, the side joists 50, and the floor plywood, and the pillars 80 on the second floor can be fitted more horizontally.

Figure 7:
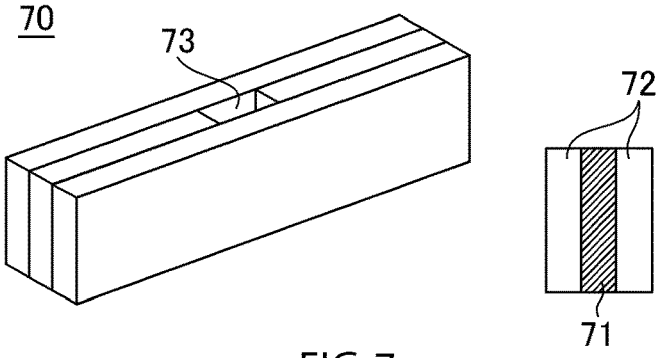
FIG. 7 is a schematic view illustrating a roof beam used for the building relating to one embodiment of the present invention.

FIG. 7 is a schematic view illustrating a roof beam 70 used for the building 100 relating to one embodiment of the present invention. It is preferable to provide a roof beam 70 at the building 100 relating to one embodiment of the present invention. The roof beam 70 is provided vertically to the third upper frame 40 illustrated in FIG. 5(C) to build a roof. For example, the roof beam 70 may be formed by using three 206 materials 71, 72 or the like having same plate width.

A mortise 73 is provided at least at a part of the roof beam 70 in longitudinal direction. The mortise 73 is a through hole. As illustrated in FIG. 7, it is preferable that the mortise 73 provided at the roof beam 70 is formed by two or more intermediate sawn plates 71, for example 206 material or the like, aligned at intervals in a line of horizontal direction, and by two sawn plates 72 interposing the intermediate sawn plates 71 at both sides and having longer entire length than the two or more intermediate sawn plates 71, the intermediate sawn plates 71 and two sawn plates 72 at both sides are having same plate width.

Figure 8:
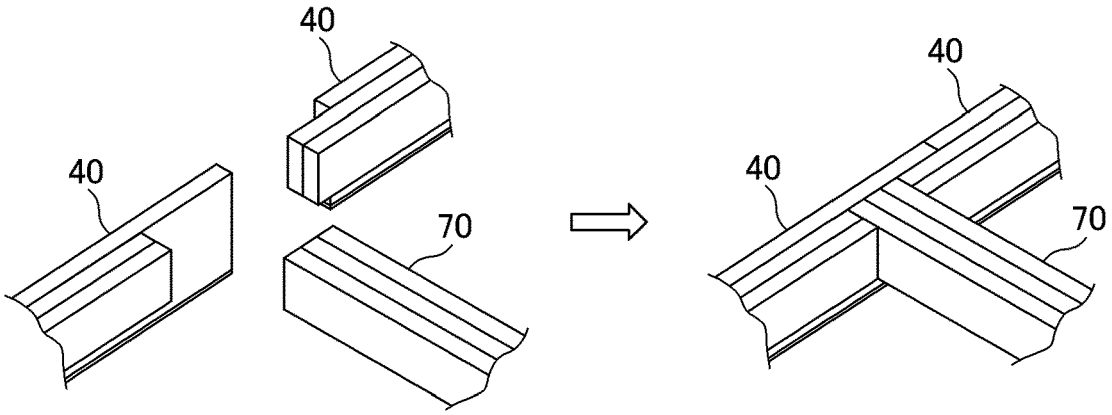
FIG. 8 is a schematic view illustrating a joining of the third upper frames themselves and the roof beam used for the building relating to one embodiment of the present invention.

As illustrated in FIG. 8, it is preferable that the third upper frames 40 and the roof beam 70 are provided such that the roof beam 70 will be vertical to a frame in which the third upper frames 40 themselves are fitted to each other.

Figure 9:
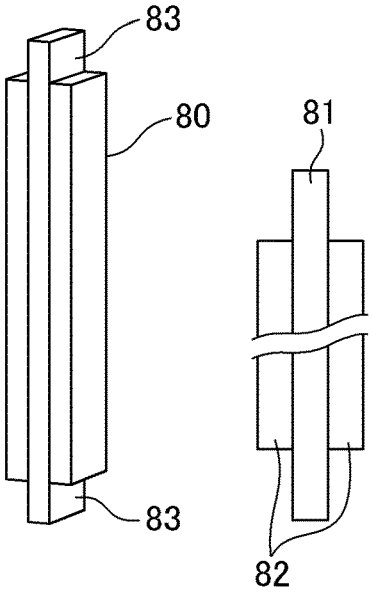
FIG. 9 is a schematic view illustrating a pillar used for the building relating to one embodiment of the present invention.

FIG. 9 is a schematic view illustrating a pillar 80 used for the building 100 relating to one embodiment of the present invention. For example, a pillar 80 may be formed by using three 204 materials 81, 82 or the like. The pillar 80 is provided with protrusions 83 at both ends in longitudinal direction, which can be fitted to the mortises 15, 25, 35, 55, 73 provided at the lower frame 10, the first upper frame 20, the second upper frame 30, the side joist 50, and the roof beam 70. And, it is preferable that the protrusions 83 provided at the pillar 80 is formed by interposing one intermediate sawn plate 81 at both sides by two sawn plates 82 having shorter entire length than the intermediate sawn plate 81, the intermediate sawn plate 81 and two sawn plates 82 at both sides are having same plate width.

Here, instead of forming the mortises in the building 100 relating to one embodiment of the present invention, it can be considered to form the recessed groove 23 over entire length in longitudinal direction of the first upper frames 20 illustrated in FIG. 5(A), and not to form the mortises, and in that case, freedom of construction will be improved as fine adjustment of positions to stand the pillars will be possible, but the positions of the pillars are not clearly indicated, so work efficiency may be decreased. In addition, in the above case, the pillars will be temporary fixed by nails or the like, but as it is only fixed temporary, the pillars are not fixed completely and unstable, so it will be difficult to fit the upper frames to the pillars. Therefore, the mortises will be formed to the building 100 relating to one embodiment of the present invention. By forming the mortises, the positions to stand the pillars will be clear. In addition, there will not be a problem even for non-skilled workers.

From the above, the building 100 as illustrated in FIG. 1 is completed using the horizontal members and the vertical members as illustrated in FIGS. 4 to 9. According to the building 100 relating to one embodiment of the present invention, materials can be joined easily without special processing by forming mortises, so a building with improved workability, and also, which does not cause a variation in a quality of buildings, is provided. In addition, it is possible to set up a framework in short time with few workers, as it is easy to construct.

In addition, it is preferable that a depth of the mortises 15, 25, 35, 55, 73 of the lower frame 10, the first upper frame 20, the second upper frame 30, the side joist 50, and/or the roof beam 70 are greater than a height of the protrusions 83 of the pillar 80. In this way, even when a height of the protrusions 83 of the pillar 80 becomes higher than a depth of the mortises 15, 25, 35, 55, 73 of the lower frame 10, the first upper frame 20, the second upper frame 30, the side joist 50, and/or the roof beam 70, and a depth of the recessed groove 23 of the first upper frame 20, by expansion by humidity, the pillar 80 can be fitted to the lower frame 10, the first upper frame 20, the second upper frame 30, the side joist 50, and/or the roof beam 70, without cutting down a part of the protrusions 83 which became higher, so it is possible to provide the building 100 which does not cause a variation in a quality of buildings, as there will be no deviation when the building 100 is completed.

It is preferable that 204 material, 205 material, 206 material, 208 material, 210 material, and 212 material are used as the horizontal members and the vertical members. In this way, it is possible to correspond to various materials.

As mentioned above, the horizontal members and the vertical members used for the building 100 relating to one embodiment of the present invention may be formed by interposing and laminating a plurality of sawn plates. For example, the lower frame 10, the first upper frame 20, the second upper frame 30, the third upper frame 40, the side joist 50, the roof beam 70, and the pillar 80 are formed by interposing and laminating two or three sawn plates, and in this way, it is possible to reduce a loss of material of sawn plates by reforming torsion or bending of each material. And, a joint equivalent to the conventional construction method can be formed by simple processing, for example by cutting length.

The lower frame 10, the first upper frame 20, the second upper frame 30, the side joist 50, and the pillar 80 may be formed in equivalent shape from solid wood, laminated wood, or laminated veneer lumber. In other words, the lower frame, the first upper frame, the second upper frame, the side joist, and the pillar may be formed in equivalent shape from solid wood, laminated wood, or laminated veneer lumber, instead of two or more sawn plates. In this way, it is possible to correspond to solid wood, laminated wood, or laminated veneer lumber. In addition, the roof beam 70 may be formed in equivalent shape from solid wood, laminated wood, or laminated veneer lumber.

It is preferable that the building 100 relating to one embodiment of the present invention further comprises a fixing metal fitting 90 for joining the pillar 80 and the lower frame 10. The fixing metal fitting 90 is referring to a fixing metal fitting described in International Application No. PCT/JP2018/000284. As illustrated in FIG. 1, the fixing metal fitting 90 is a joint metal for joining the pillar 80 to the lower frame 10 provided on the sill 2, and the fixing metal fitting 90 is embedded in the pillar 80 and the lower frame 10.

Figure 10:
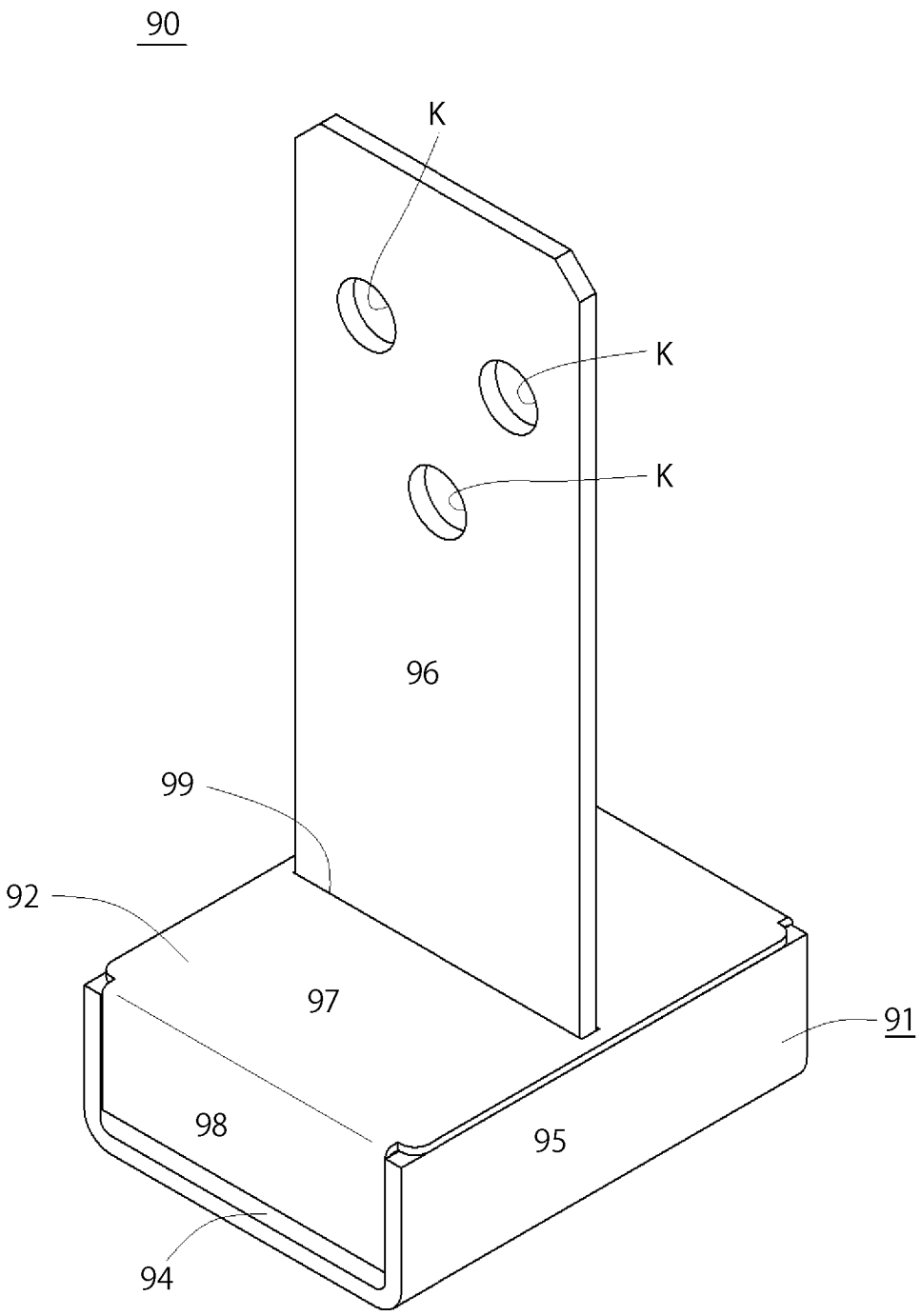
FIG. 10 is a schematic view illustrating a fixing metal fitting used for the building relating to one embodiment of the present invention.
Figure 11:
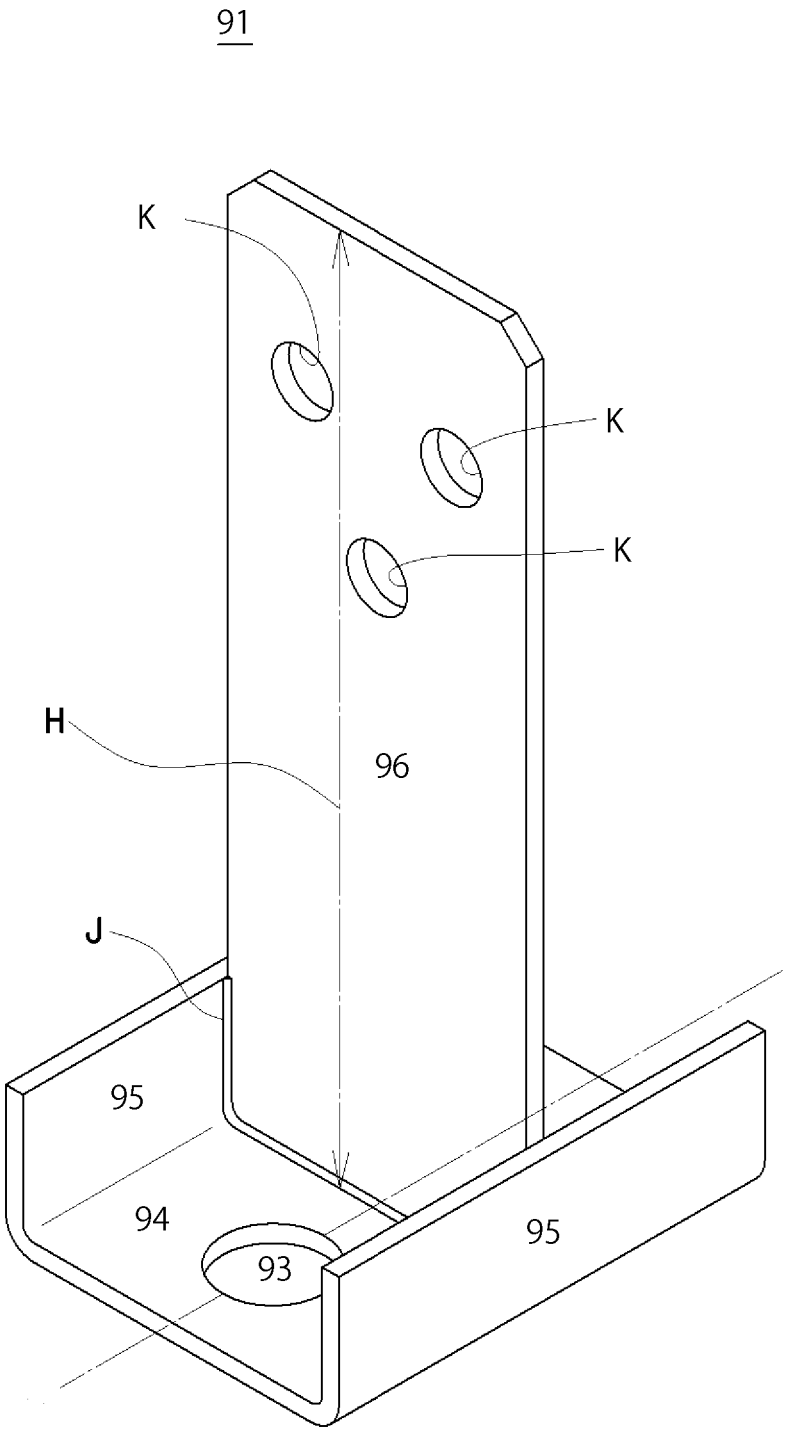
FIG. 11 is a schematic view illustrating the fixing metal fitting, in which a cover spacer is removed, that is a joint base used for the building relating to one embodiment of the present invention.

As illustrated in FIG. 10 or 11, the fixing metal fitting 90 comprises: a joint base 91 in groove shape mainly composing a joint metal; and a cover spacer 92 in groove shape capable of supporting axial load of the pillar 80 by covering an open surface of the joint base 91. And, the joint base 91 comprises: a plane section 94 in rectangular shape in which bolt holes 93 are drilled and a shape of which coincides with an end surface of the pillar 80; a pair of groove walls 95 composed of side edges of the plane section 94 respectively bent vertically in L shape; and a joining plate 96 standing at a height surpassing the groove walls 95 from the plane section 94 and supported by welded part J contacting at least the pair of the groove walls 95 or a groove bottom. In addition, the cover spacer 92 comprises: a plane section 97 in rectangular shape for supporting the pillar 80 by abutting to the end surface of the pillar 80; a pair of groove walls 98 composed of side edges of the plane section 97 respectively bent vertically in L shape; and a slit 99 drilled such that the joining plate 96 will be fitted into the slit 99 when the cover spacer 92 is covering the joint base 91. In addition, it is preferable that a bottom surface of the joint base 91 is a plane surface.

It is preferable that, in a state assembled as the joint metal, fastening bolts penetrated through or embedded in the lower frame 10 are penetrated through the bolt holes 93, and the plane section 94 of the joint base 91 is fastened to the lower frame 10 by nuts, further, the joining plate 96 is penetrated through the slit 99, and also, tips of the fastening bolts and the nuts screwed to the fastening bolts are housed in a box-shaped space surrounded by the joint base 91 and the cover spacer 92, the end surface of the pillar 80 abuts the plane section 97 of the cover spacer 92, and also, the pillar 80 and the joining plate 96 fitted into a groove hole drilled at the pillar 80 are drift-pin joined by a plurality of drift pins. In addition, the plurality of drift pins penetrate through drift-pin holes K.

In this way, it is possible to provide a building with improved workability, and also, which does not cause a variation in a quality of buildings, by enabling materials to be joined easily without special processing, as the pillars can be fitted easily to the lower frames and structural strength will be improved.

[2. Construction Method]

Figure 12:
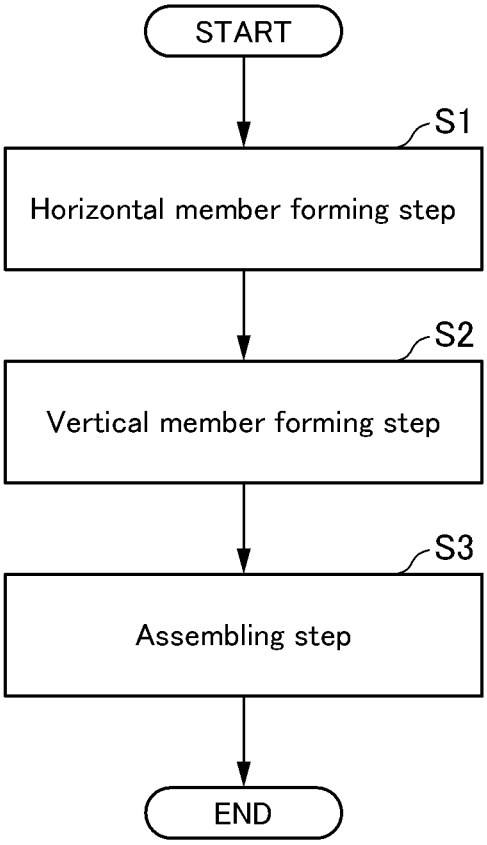
FIG. 12 is a flow chart illustrating an outline of a construction method relating to other embodiment.

Next, explaining about a construction method relating to one embodiment of the present invention. As illustrated in FIG. 12, the construction method relating to one embodiment of the present invention is a construction method for fitting and assembling at least horizontal members and vertical members at the construction site, comprising: a horizontal member forming step S1 for forming the horizontal members; a vertical member forming step S2 for forming the vertical members; and an assembling step S3 for fitting and assembling the horizontal members and the vertical members. The construction method relating to one embodiment of the present invention is a construction method using the horizontal members and the vertical members. Explaining in detail in below per each step. In addition, matters overlapping with the content explained in the above will be omitted as possible.

[2-1. Horizontal Member Forming Step]

The horizontal member forming step S1 is a step for forming the horizontal members. Lower frames 10, first upper frames 20, second upper frames 30, and side joists 50 are provided as the horizontal members. The lower frames 10, the first upper frames 20, the second upper frames 30, and the side joists 50 are provided with mortises 15, 25, 35, 55 at least at a part of the lower frames 10, the first upper frames 20, the second upper frames 30, and the side joists 50 in longitudinal direction. In addition, the first upper frames 20 are provided with a recessed groove 23 over entire length in longitudinal direction, and the second upper frames 30 are provided with a protrusion 36 over entire length in longitudinal direction. The mortises 15, 25 provided at the lower frames 10 and the first upper frames 20 are through holes It is preferable that third upper frames 40 are further provided as the horizontal members, and the third upper frames 40 is provided to be fitted to the second upper frames 30 such that a difference at one side of the protrusion 36 provided at the second upper frames 30 will be absorbed.

It is preferable that the mortises 15 provided at the lower frames 10 are formed by two or more intermediate sawn plates 11 aligned at intervals in a line of horizontal direction, and by two sawn plates 12 interposing the intermediate sawn plates 11 at both sides and having longer entire length than the two or more intermediate sawn plates 11, the intermediate sawn plates 11 and the two sawn plates 12 at both sides are having same plate width.

In addition, it is preferable that the mortises 25 provided at the first upper frames 20 are formed by two or more intermediate sawn plates 21 aligned at intervals in a line of horizontal direction, and by two sawn plates 22 interposing the intermediate sawn plates 21 at both sides and having longer entire length than the two or more intermediate sawn plates 21, the intermediate sawn plates 21 and the two sawn plates 22 at both sides are having same plate width or different plate width. How to form the mortises 35 provided at the second upper frames 30 is same as the mortises 25 of the first upper frames 20.

In addition, it is preferable that the recessed groove 23 provided at the first upper frames 20 is formed by interposing the intermediate sawn plates 21 at both sides by the two sawn plates 22 having wider plate width than the intermediate sawn plates 21.

In addition, it is preferable that the protrusion 36 provided at the second upper frames 30 is formed by providing a sawn plate 31 with same plate width as the two sawn plates 32 at both sides on the intermediate sawn plates 33. It is preferable that the mortises 55 provided at the side joists 50 are formed by two sawn plates 51, 52 with same plate width and two or more sawn plates 53 with different plate width provided at intervals on the sawn plate 52 which is fitted to the recessed groove 23 of the first upper frame 20.

The plurality of sawn plates described in the above and a plurality of sawn plates described in below may be bonded by publicly known method.

[2-2. Vertical Member Forming Step]

The vertical member forming step S2 is a step for forming the vertical members. Pillars and framework walls are provided as the vertical members. In addition, the pillars 80 are provided with protrusions 83 at both ends, which can be fitted into the mortises 15, 25, 35, 55 provided at the lower frames 10, the first upper frames 20, the second upper frames 30, and the side joists 50.

It is preferable that the protrusions 83 provided at the pillars 80 are formed by interposing one intermediate sawn plate 81 at both sides by two sawn plates 82 having shorter entire length than the intermediated sawn plate 81, the intermediate sawn plate 81 and the two sawn plates 82 at both sides are having same plate width.

[2-3. Assembling Step]

The assembling step S3 is a step for fitting and assembling the horizontal members and the vertical members formed by the horizontal member forming step S1 and the vertical member forming step S2. How to assemble actually is as explained in FIGS. 2 and 3.

In addition, it is preferable that the horizontal member forming step S1 and the vertical member forming step S2 are performed at the construction site. In the case of conventional construction method, all members are produced in a factory, and the produced members are transferred to the construction site and assembled, but for example, when a member is missing due to a breakage or the like, it is necessary to reorder the missing member to the factory and wait for production and arrival of the missing member, however, the members used for the construction method relating to one embodiment of the present invention are easy to be formed and processed, so they can be produced easily at the construction site.

From the above, according to the construction method relating to one embodiment of the present invention, it is possible to provide a construction method with improved workability, and also, which does not cause a variation in a quality of buildings, by enabling materials to be joined easily without special processing by forming mortises. In addition, it is possible to set up a framework in short time with few workers, as it is easy to construct. Further, there will not be a problem even for non-skilled workers.

It is preferable that the construction method relating to one embodiment of the present invention further comprises the above-mentioned fixing metal fittings. The details of the fixing metal fittings are as described in the above.

In addition, it is explained in detail about each embodiment and each example of the present invention as the above, but it is easy for those who skilled in the art to understand that various modifications are possible without substantially departing from new matters and effects of the present invention. Therefore, all of such modified examples are included within the scope of the present invention.

For example, a term used at least once in the description or drawings together with a different term that is broader or the same in meaning can also be replaced by the different term in any place in the description or drawings. Further, the structure and the operation of the building and the construction method are not limited to those described in each embodiments and examples of the present invention, but may be carried out in various modifications.

There is a possibility that the building and the construction method relating to one embodiment of the present invention will be adopted to two by four building and other buildings, and construction methods thereof.

Glossary of Drawing References

10 Lower frame
11 Intermediate sawn plate
12 Sawn plates at both sides
15 Mortise

18 Protrusion
19 Recess
20 First upper frame
21 Intermediate sawn plate
22 Sawn pates at both sides
23 Recessed groove
25 Mortise
28 Protrusion
29 Recess
30 Second upper frame
31 Intermediate sawn plate
32 Sawn plates at both sides
33 Intermediate sawn plate
33' Sawn plate
35 Mortise
36 Protrusion
37 Packing
37' Packing
38 Protrusion
39 Recess
40 Third upper frame
41 Sawn plate
42 Sawn plate
43 Packing
48 Protrusion
50 Side joist
51 Sawn plate
52 Sawn plate
53 Sawn plate
54 Packing
55 Mortise
60 Joist single
61 Sawn plate
62 Sawn plate
63 Packing
65 Joist triple
66 Sawn plates at both sides
67 Intermediate sawn plate
68 Sawn plate
69 Packing
70 Roof beam
71 Intermediate sawn plate
72 Sawn plates at both sides
73 Mortise
80 Pillar
81 Intermediate sawn plate
82 Sawn plates at both sides
83 Protrusion
90 Fixing metal fitting
91 Joint base
92 Cover spacer
93 Bolt hole
94 Plane section in rectangular shape
95 Groove walls of joint base
96 Joining plate
97 Plane section of cover spacer
98 Groove walls of cover spacer
99 Slit
H Height
J Welded part
K Drift-pin hole
100 Building
S1 Horizontal member forming step
S2 Vertical member forming step
S3 Assembling step

The invention claimed is:

1. A wooden building constructed by fitting horizontal members and vertical members, comprising:

lower frames, first upper frames, second upper frames, and side joists as the horizontal members; and pillars as the vertical members, wherein the lower frames, the first upper frames, the second upper frames, and the side joists are provided with mortises at least at a part of the lower frames, the first upper frames, the second upper frames, and the side joists in longitudinal direction, the first upper frames are provided with a recessed groove over an entire length in a longitudinal direction, the second upper frames are provided with a protrusion over the entire length in the longitudinal direction, the mortises provided at the lower frames and the first upper frames are through holes, and the pillars are provided with protrusions on at least two longitudinal ends, which are configured to be fitted into the mortises provided at the lower frames, the first upper frames, the second upper frames, and the side joists.

2. The building according to claim 1, further comprising third upper frames as the horizontal members, wherein the third upper frames are provided to be fitted to the second upper frames such that a difference at one side of the protrusion provided at the second upper frames is absorbed.

3. The building according to claim 1, wherein the mortises provided at the lower frames are formed by two or more intermediate sawn plates aligned at intervals in a line of horizontal direction, and by two sawn plates interposing the intermediate sawn plates on opposite sides of the intermediate sawn plates and having longer entire length than the two or more intermediate sawn plates, the intermediate sawn plates and two sawn plates having same plate width, the mortises provided at the first upper frames and the second upper frames are formed by two or more intermediate sawn plates aligned at intervals in a line of horizontal direction, and by two sawn plates interposing the intermediate sawn plates and having longer entire length than the two or more intermediate sawn plates, the intermediate sawn plates and two sawn plates having same plate width or different plate width, the recessed groove provided at the first upper frames is formed by interposing the intermediate sawn plates by two sawn plates having wider plate width than the intermediate sawn plates, the protrusion provided at the second upper frames is formed by providing a sawn plate with same plate width as the two sawn plates of the second upper frames on the intermediate sawn plates of the second upper frames, the mortises provided at the side joists are formed by two sawn plates with same plate width and two or more sawn plates with different plate width provided at intervals on one of the two sawn plates which is fitted to the recessed groove of the first upper frames, and the protrusions provided at the pillars are formed by interposing one intermediate sawn plate by two sawn plates having shorter entire length than the intermediated sawn plate, the intermediate sawn plate and two sawn plates having same plate width.

4. The building according to claim 1, further comprising fixing metal fittings for joining the pillars to the lower frames, the fixing metal fittings are respectively provided with a joint base in groove shape mainly composing a joint metal, and a cover spacer in groove shape capable of supporting axial load of a pillar of the pillars by covering an open surface of the joint base, the joint base comprises:

a plane section in rectangular shape in which bolt holes are drilled and a shape of which coincides with an end surface of the pillar;

a pair of groove walls composed of side edges of the plane section respectively bent vertically in L shape; and a joining plate standing at a height surpassing the groove walls from the plane section and supported by welded part contacting at least the pair of the groove walls or a groove bottom, the cover spacer comprises:

a plane section in rectangular shape for supporting the pillar by abutting to the end surface of the pillar;

a pair of groove walls composed of side edges of the plane section respectively bent vertically in L shape; and a slit drilled such that the joining plate is fitted into the slit when covering the joint base, wherein, in a state assembled as the joint metal, fastening bolts penetrated through or embedded in a horizontal member of the horizontal members are penetrated through the bolt holes, and the plane section of the joint base is fastened to the horizontal member by a nut, further, the joining plate is penetrated through the slit, and also, tips of the fastening bolts and the nuts screwed to the fastening bolts are housed in a box-shaped space surrounded by the joint base and the cover spacer, the end surface of the pillar abuts the plane section of the cover spacer, and also, the pillar and the joining plate fitted into a groove hole drilled at the pillar are drift-pin joined by a plurality of drift pins.

5. The building according to claim 1, wherein a depth of the mortises of the lower frames, the first upper frames, the second upper frames, and the side joists are larger than a height of the protrusions of the pillars.

6. The building according to claim 1, wherein a protrusion or a recess are provided at a longitudinal end in a longitudinal direction of each of the lower frames, the first upper frames and the second upper frames.

7. The building according to claim 1, wherein 2×4 material, 2×5 material, 2×6 material, 2×8 material, 2×10 material, and 2×12 material are used as the horizontal members and vertical members.

8. The building according to claim 1, wherein the lower frames, the first upper frames, the second upper frames, the side joists, and the pillars are formed in equivalent shape from solid wood, laminated wood, or laminated veneer lumber.

9. A construction method for fitting and assembling at least horizontal members and vertical members at a construction site, the construction method comprising:

a horizontal member forming step for forming the horizontal members;

a vertical member forming step for forming the vertical members; and an assembling step for fitting and assembling the horizontal members and the vertical members, wherein lower frames, first upper frames, second upper frames and side joists are provided as the horizontal members, pillars are provided as the vertical members, the lower frames, the first upper frames, the second upper frames, and the side joists are provided with mortises at least at a part of the lower frames, the first upper frames, the second upper frames, and the side joists in longitudinal direction, the first upper frames are provided with a recessed groove over an entire length in a longitudinal direction, the second upper frames are provided with a protrusion over the entire length in the longitudinal direction, the mortises provided at the lower frames and the first upper frames are through holes, and the pillars are provided with protrusions on at least two longitudinal ends, which are configured to be fitted into the mortises provided at the lower frames, the first upper frames, the second upper frames, and the side joists.

10. The construction method according to claim 9, wherein third upper frames are further provided as the horizontal members, and the third upper frames are provided to be fitted to the second upper frames such that a difference at one side of the protrusion provided at the second upper frames is absorbed.

11. The construction method according to claim 9, wherein the mortises provided at the lower frames are formed by two or more intermediate sawn plates aligned at intervals in a line of horizontal direction, and by two sawn plates interposing the intermediate sawn plates on opposite sides of the intermediate sawn plates and having longer entire length than the two or more intermediate sawn plates, the intermediate sawn plates and the two sawn plates having same plate width, the mortises provided at the first upper frames and the second upper frames are formed by two or more intermediate sawn plates aligned at intervals in a line of horizontal direction, and by two sawn plates interposing the intermediate sawn plates and having longer entire length than the two or more intermediate sawn plates, the intermediate sawn plates and the two sawn plates having same plate width or different plate width, the recessed groove provided at the first upper frames is formed by interposing the intermediate sawn plates by the two sawn plates having wider plate width than the intermediate sawn plates, the protrusion provided at the second upper frames is formed by providing a sawn plate with same plate width as the two sawn plates of the second upper frames on the intermediate sawn plates of the second upper frames, the mortises provided at the side joists are formed by two sawn plates with same plate width and two or more sawn plates with different plate width provided at intervals on one of the two sawn plates which fits into the recessed groove of the first upper frames, and protrusions provided at the pillars are formed by interposing one intermediate sawn plate by two sawn plates having shorter entire length than the intermediated sawn plate, the intermediate sawn plate and the two sawn plates having same plate width.

12. The construction method according to claim 9, wherein the horizontal member forming step and/or the vertical member forming step are performed at the construction site.

* * * * *